US006009047A

United States Patent [19]

Barger

[11] Patent Number: 6,009,047

[45] Date of Patent: Dec. 28, 1999

[54] SOUND GENERATION DEVICE

[75] Inventor: James Edwin Barger, Winchester, Mass.

[73] Assignee: GTE Internetworking Incorporated, Burlington, Mass.

[21] Appl. No.: 09/127,199

[22] Filed: Jul. 31, 1998

[51] Int. Cl.[6] ..... H04R 23/00; H04R 9/00

[52] U.S. Cl. ..... 367/175; 367/141; 310/337

[58] Field of Search ..... 367/175, 174, 367/141; 310/337

[56] References Cited

U.S. PATENT DOCUMENTS

| | | | |
|---|---|---|---|
| 3,725,856 | 4/1973 | Chervenak | 367/141 |
| 5,199,005 | 3/1993 | Forsberg | 367/175 |
| 5,206,839 | 4/1993 | Murray | 367/175 |
| 5,206,859 | 4/1993 | Anzai | 370/110.1 |
| 5,266,854 | 11/1993 | Murray | 310/36 |
| 5,305,288 | 4/1994 | Kupiszewski et al. | 367/175 |

*Primary Examiner*—Ian J. Lobo
*Attorney, Agent, or Firm*—Leonard Charles Suchyta

[57] ABSTRACT

A sound generating device for generating a sound wave in a body of water is provided. The device includes a pair of axially aligned pistons. An electromagnet is mounted on at least one of the pistons. Activation of the electromagnet causes the pistons to move towards each other. A spring is positioned between the pistons and biases the pistons away from each other. Provision is made for changing the spring rate during operation so that the device will operate at mechanical resonance throughout the intended frequency range. A control device controls the current flowing through the electromagnets. The current is controlled to induce a predetermined variance of axial displacement between the pistons and thereby generate a sound wave.

31 Claims, 9 Drawing Sheets

SOUND GENERATION DEVICE

BACKGROUND OF THE INVENTION

The present invention relates to the field of sound generation. More particularly, the invention relates to a device for producing sound waves in a body of water.

There are many circumstances in which it is desirable to produce sound waves in a body of water. Seismic visualization of marine oil reservoirs is one example. Seismic visualization is a technique used to determine the size and shape of underground oil reservoirs. The technique involves radiating sound waves into the earth's surface above the reservoir and then capturing the reflected sound waves. The acoustic characteristics of the reflected sound waves are then analyzed to visualize the size and shape of the underground reservoir as well as the geological formations in the area surrounding the reservoir. This technique is useful when exploring for new oil reservoirs and also for managing oil production from a known oil reservoir.

Exploring for new oil reservoirs typically involves methodically visualizing a particular subterranean area. A basic level of visual detail is needed to determine if and where an oil reservoir is located. However, after an oil reservoir has been located, a more detailed view of the reservoir and surrounding areas is required to effectively manage the production of oil from the reservoir. The increased visual detail is required to locate optimal drilling locations to maximize the production of oil.

The level of visual detail afforded by a seismic visualization system is largely dependent upon the capabilities of the sound generating device. In general, a device producing a large bandwidth of frequencies can provide the more detailed visualization. Typically, when exploring for new oil reservoirs, devices producing frequencies of less than 70 Hz are capable of generating a resolution detailed enough to locate oil reservoirs. In production management, however, greater frequencies are required to adequately visualize the geological features surrounding the oil reservoir.

Generating sound waves in a body of water for seismic visualization purposes is typically performed with a device called an air gun array. The air guns within the array are detonated above the sea bottom to generate a sound wave that travels through the water to the earth's surface. The sound is partially transmitted through the surface and is partially reflected back from the stratified geological interfaces below. The reflections are sensed by any of several any of several known devices that are capable of interpreting the echoes and producing the visualization of the subterranean area.

The use of air guns to seismically visualize oil reservoirs in a marine environment presents several problems. Because of the design of the typical air gun, a large air gun is required to generate a sound wave having enough power to effectively visualize a reservoir. Thus, a large carrying vessel is required. In addition, the sound generated by the air gun cannot be radiated preferentially downward towards the oil reservoir. As a result a large amount of unwanted signals are echoed back from undesirable objects. A significant amount of signal processing is required to filter out the undesired echoes.

The frequency bandwidth of air guns is also limited. Currently, known air guns radiate insufficient power at frequencies greater than about 70 Hz. The limited frequency bandwidth provides insufficient resolution to visualize the oil—water interface within the formation. It is of great importance to effective oil - field management that successive locations of this interface be visualized at different times during production. In addition, the great power output of the air guns directed into a water body presents several environmental concerns. In particular, air guns are believed to present a serious threat to the nearby sea life.

In light of the foregoing there is a need for an environmentally friendly device capable of radiating a low frequency, high powered, and broad band of sound.

SUMMARY OF THE INVENTION

Accordingly, the present invention is directed to a device for generating sound waves in a body of water that addresses one or more of the limitations and disadvantages of the prior art sound generation devices. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a device for generating a sound wave in a body of water. The device includes first and second axially aligned pistons. An electromagnet is mounted on at least one of the first and second pistons. The electromagnet axially displaces the one piston towards the other when the electromagnet is activated by an electric current. A main spring is positioned between the pistons and biases the pistons away from each other. There are provided means for adjusting the main spring rate so as to cause the device to operate at mechanical resonance throughout the frequency range of the device. There is also provided a control device that is in electrical connection with the electromagnet. The control device regulates the flow of electricity to the electromagnet to induce a predetermined variance of axial displacement between the first and second pistons. The axial displacement of the pistons generates the sound wave.

According to another aspect, the invention is directed to a device for generating a sound wave in a body of water. The device includes first and second axially aligned pistons. An attracting means is provided to displace the first piston toward the second piston. A main spring is positioned between the first and second pistons to bias the first piston away from the second piston. There are provided means for adjusting the main spring rate so as to cause the device to operate at mechanical resonance throughout the frequency range of the device. There is also provided a controlling means to control the attracting means and to induce a predetermined pattern of movement between the first and second pistons to thereby generate the sound wave.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Reference will now be made in detail to the presently preferred embodiments of the invention, examples of which are illustrated in the accompanying drawings. Wherever possible, the same reference numbers will be used throughout the drawings to refer to the same or like parts.

In accordance with the present invention, a device for generating a sound wave in a body of water is provided. The device includes first and second axially aligned pistons. An electromagnet is mounted on at least one of the first and second pistons. When the electromagnet is activated by an electrical current, the electromagnet axially displaces one piston toward the other. The axial displacement of the one piston toward the other causes the volume of water occupied by the device to change, thereby generating a sound wave with sound pressure proportional to the acceleration of volume change.

Figure 1:
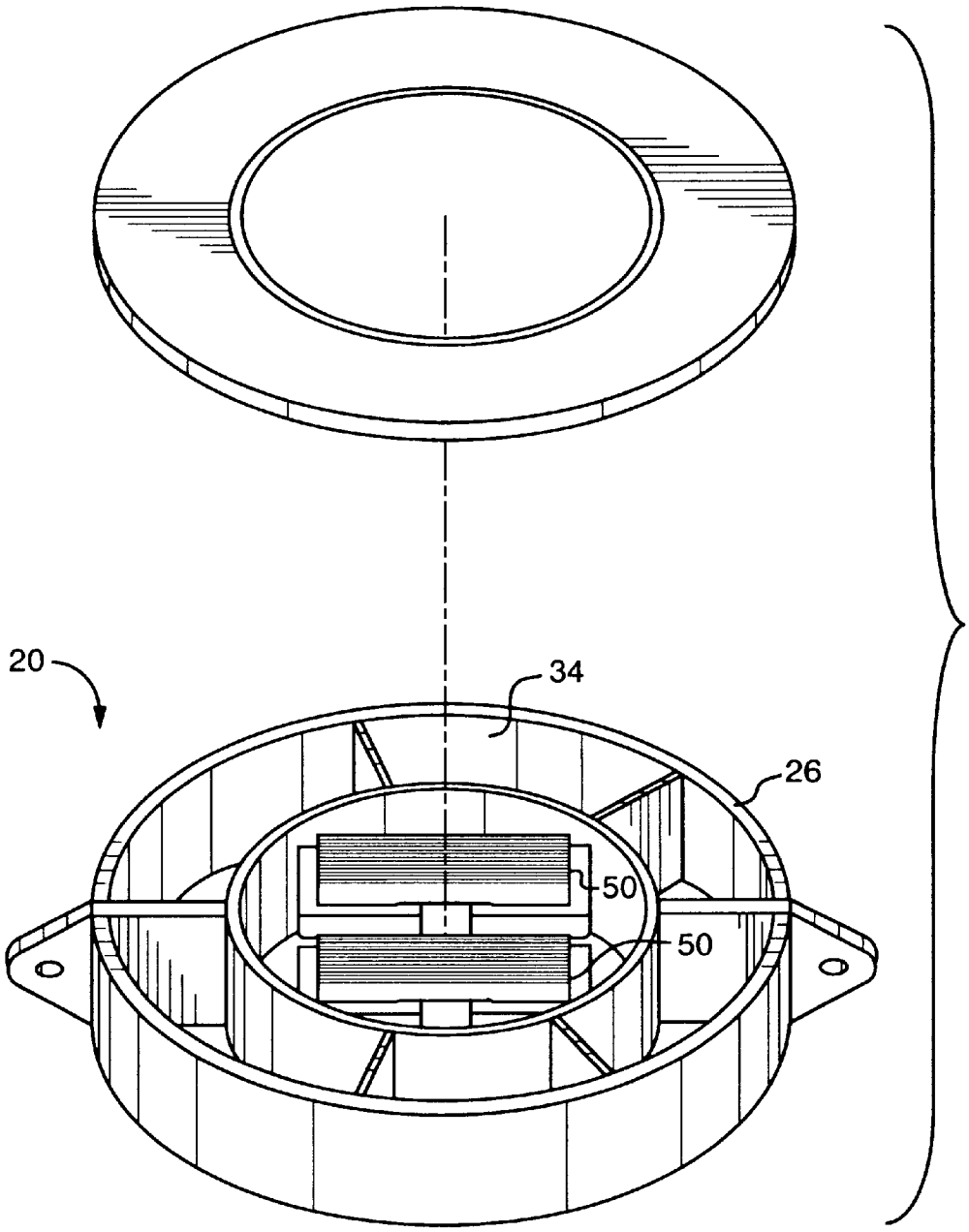
FIG. 1 is a pictorial view of the sound generating device of the present invention.

The generated sound wave may be used in a seismic visualization apparatus or in any other underwater operation that requires a low frequency, high powered, broad band sound to be radiated, for example sonar or fish finding. The present invention contemplates the use of a series of devices, working together as an array, to produce sound waves for any of the previously mentioned purposes. An exemplary embodiment of the device of the present invention is shown in FIG. 1 and is designated generally by reference number 20.

Figure 2:
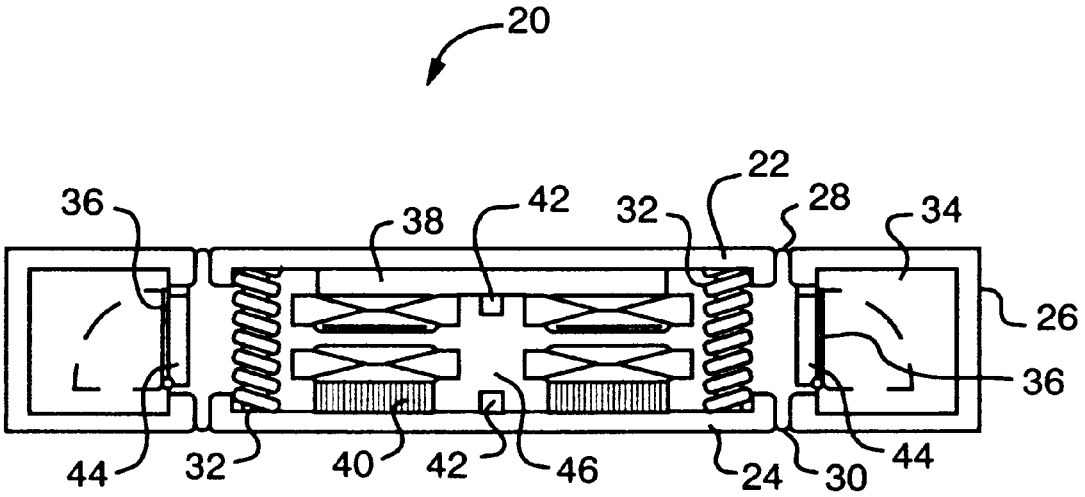
FIG. 2 is a side cross sectional view of the device of FIG. 1.

As embodied herein and illustrated in FIG. 2, the device 20 includes a first piston 22 and a second piston 24. First piston 22 is axially aligned with second piston 24. In the exemplary embodiment, pistons 22 and 24 have a generally circular cross section although the present invention contemplates the use of pistons having other shapes. Pistons 22 and 24 are preferably made of a light stiff material, for example carbon reinforced epoxy, aluminum, titanium, and honeycomb sandwich structures.

An outer casing 26 is positioned around the perimeter of pistons 22 and 24. Outer casing 26 is connected to first piston 22 by a first rolling seal 28 and outer casing 26 is connected to second piston 24 by a second rolling seal 30. Rolling seals 28 and 30 are flexible and move axially with first and second pistons 22 and 24 to prevent water from entering device 20.

Figure 3:
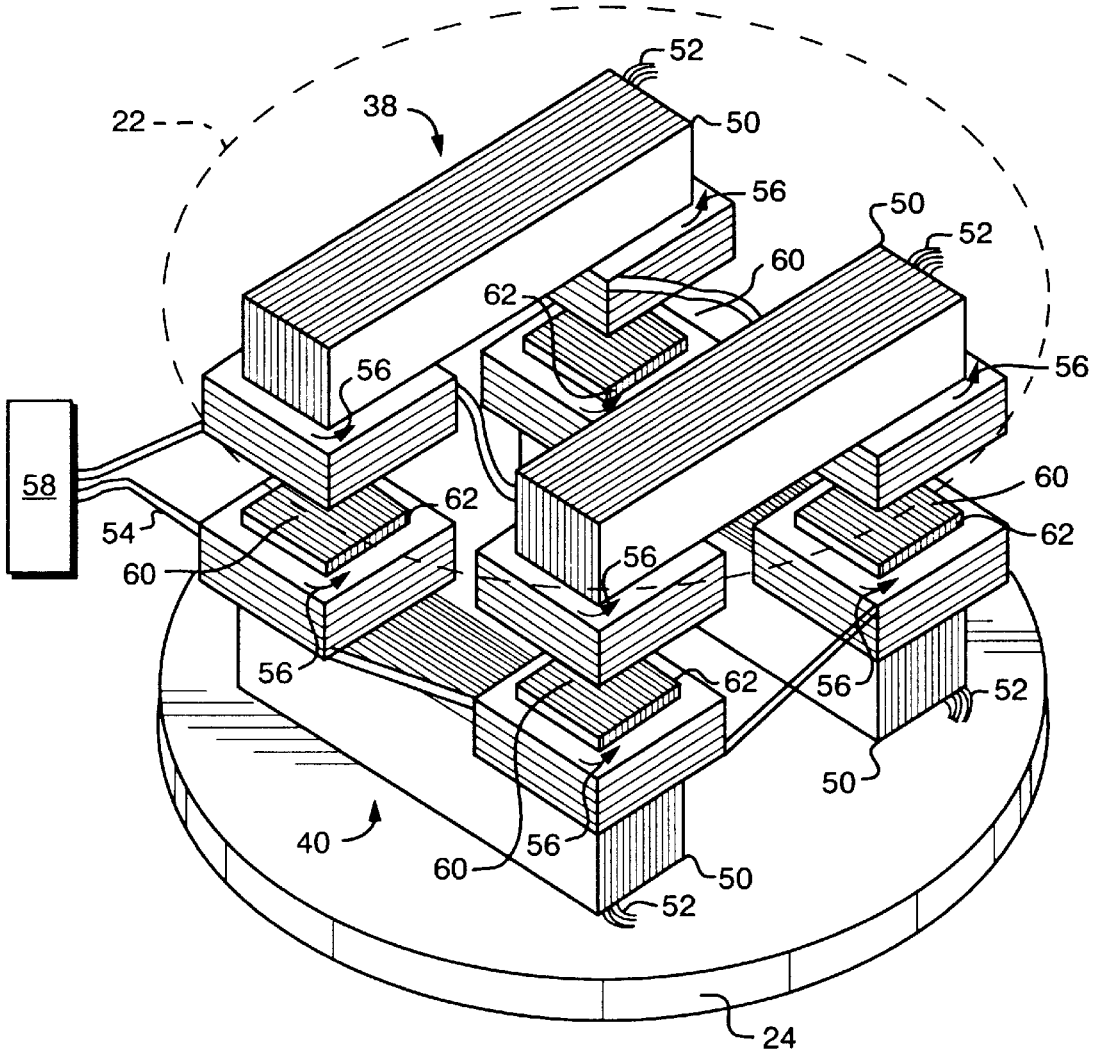
FIG. 3 is pictorial view of the electromagnets of the present invention.

In the exemplary embodiment, an electromagnet 38 is mounted on first piston 22 and an electromagnet 40 is mounted on second piston 24. As shown in FIG. 3, each electromagnet 38 and 40 includes a pair of magnetic cores 50 having ends 62. Each magnetic core is made of a series of laminated plates 52.

Figure 4:
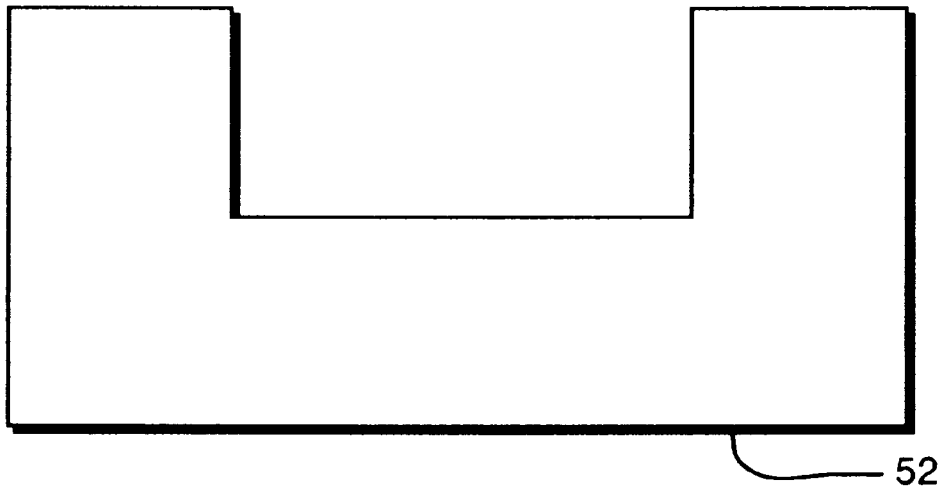
FIG. 4 is a side view of a laminate sheet of the electromagnet of FIG. 3.

As shown in FIG. 4, each individual plate 52 has a U-shaped cross section. The lamination of the series of plates 52 results in magnetic core 50 having the same cross sectional shape as the individual plates. Ends 62 each have a square cross section. The square ends 62 of magnetic cores 50 allow the opposing ends 62 of magnetic cores 50 to fully overlap with each other to ensure full coverage and maximize the magnetic attraction between opposing cores, and to minimize loss by fringing of magnetic flux through the ends 62.

In a preferred embodiment, each plate 52 is made of iron, although many other viable ferromagnetic materials will be readily apparent to one skilled in the art. The use of laminated iron plates is preferable to a core made of a solid iron piece because the laminated plates are less susceptible to generation of unwanted eddy currents that induce electrical power loss and core heating.

As illustrated in FIG. 3, magnetic cores 50 on first piston 22 are positioned opposite magnetic cores 50 on second piston 24. Ends 62 of magnetic core 50 on first piston 22 are aligned with ends 62 of magnetic cores 50 on second piston 24. Ends 62 on each piston are separated by a gap 60. A wire 54 is coiled around each end 62 of the magnetic cores 50.

The direction in which wire 54 is coiled around each end 62 is indicated by arrows 56. The direction of the coils of wire 54 is guided by the principles of electromagnetism. The coils are directed so that when a current is passed through the wire 54 around each core end 62, the resulting magnetic flux induced by each coil adds to create the total flux in the magnetic circuit formed by the magnetic cores and gaps. Since all of the gaps are in the same magnetic circuit, the flux is the same in each one. Thus, the magnetic force created by current flowing in wire 54 creates the same force across each gap. This ensures that only attractive forces are present between the two pistons and that torques are excluded.

In accordance with the principles of electromagnetism, the magnetic flux generated by each electromagnet is determined, in part, by the number of coils of wire on the particular end of the magnetic core. The size of the wire should be chosen to maximize the cross sectional area of the wire and still allow the number of coils that are required to generate the required magnetic force. A wire having a large cross section has a lower resistance and will reduce the amount of energy lost to heat generation.

Figure 5:
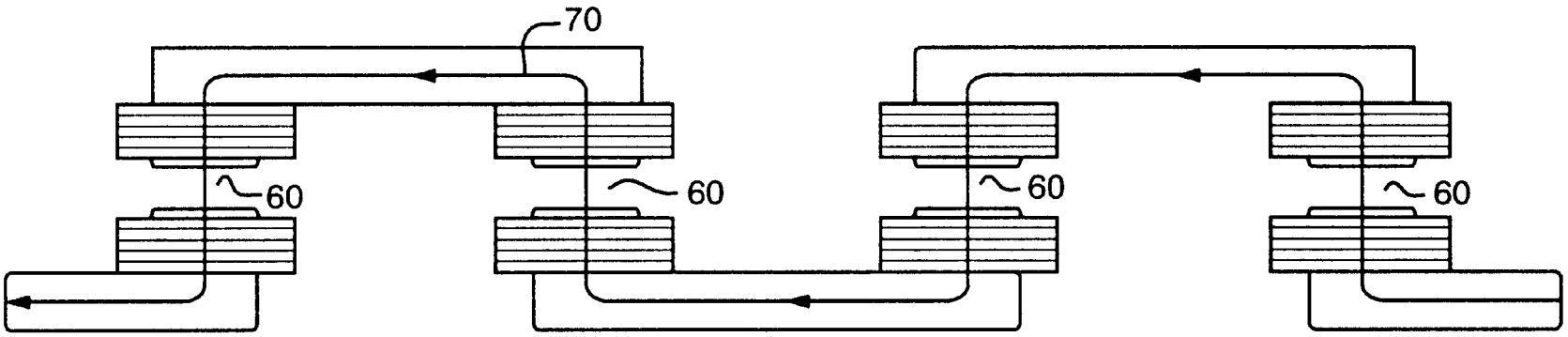
FIG. 5 is a schematic view of the flow magnetic flux created by the electromagnets of the present invention.

In the exemplary embodiment, the pair of magnetic cores 50 on first piston 22 are positioned perpendicularly to the pair of magnetic cores on second piston 24. As shown in FIG. 5, when the electromagnets are activated, the magnetic flux will flow through the magnetic cores in series as indicated by arrow 70. The serial flow of the magnetic flux also ensures that the force exerted across each gap 60 is constant and will prevent torque being applied to the two pistons, so that they will not tilt during vibration.

In the exemplary embodiment, first and second pistons 22 and 24 are the only moving parts of device 20. The low number of moving parts is beneficial in that the device is more economical and reliable than currently known devices.

In accordance with the present invention, a main spring is provided. The main spring is positioned between the first and second pistons and acts on the pistons to bias the first piston away from the second piston. In a preferred embodiment of the invention, the main spring is an air spring, although the present invention contemplates the use of other alternative spring devices that are readily apparent to one skilled in the art.

As embodied herein and shown in FIG. 2, an air chamber 46 is positioned between first and second pistons 22 and 24, and outer casing 26. Rolling seals 28 and 30 seal air chamber 46. When the previously described electromagnets are activated to move first piston 22 towards second piston 24, the air within air chamber 46 is compressed. The compressed air acts on first and second pistons 22 and 24 to oppose the electromagnetic forces. When the electromagnetic force is decreased, the compressed air causes first and second piston 22 and 24 to move away from each other.

A set of centering springs 32 are positioned between first and second pistons 22 and 24. Centering springs 32 act to move first and second pistons 22 and 24 towards each other and thus to close the gap between the pistons when the air pressure in chamber 46 equals the external hydrostatic pressure. The pressure of air within air chamber 46 imposes an effective spring rate that is greater than the spring rate of balancing springs 32, thereby controlling the gap between core ends when the pressure in chamber 46 is set higher than the external pressure.

Figure 6:
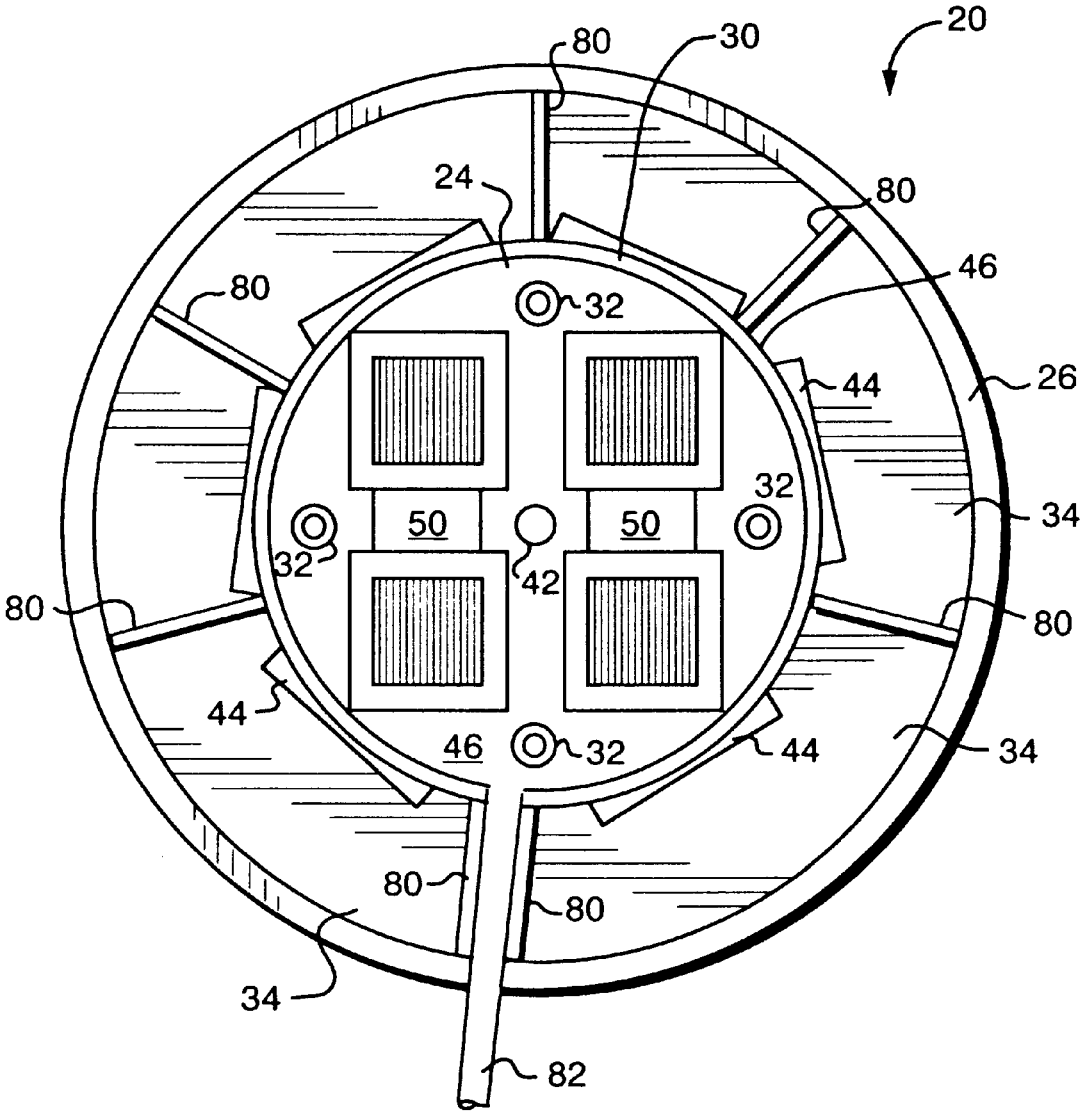
FIG. 6 is a top cross sectional view of a device according to the present invention, illustrating the air spring of the present invention.

A pressure line 82 as shown in FIG. 6 is connected to air chamber 46 to control the pressure of air within air chamber 46. Pressure line 82 may be connected to a pressure regulator (not shown). The pressure regulator can change the air pressure in air chamber 46, resulting in a change of the gap distance. Increasing the air pressure within the air spring will force the pistons away from each other and increase the gap distance between the ends of the magnetic cores. The pressure required to establish a particular gap distance must overcome both the force of the centering springs and the force of the water outside the device.

However, increasing the gap distance 60 also increases the force required of the electromagnets to axially attract the pistons. Thus, to improve the overall efficiency of the device, the gap distance should be as small as possible. But, the gap distance is also dependent upon the desired operation frequency. At low operation frequencies, the required displacement of the pistons is larger than the displacement required at a higher frequency. By including a means for changing the gap distance to be as small as possible in light of the operating frequency, the overall efficiency of the device is improved.

In the embodiment illustrated in FIG. 6, the air spring includes a means of varying the volume of air in air chamber 46. Outer casing 26 includes a number of compartments 34. Compartments 34 are separated by a plurality of walls 80. Walls 80 are positioned to give each compartment 34 a different shape and, thus, a different volume.

A series of valves 36 are positioned in ports 44 that separate air chamber 46 from compartments 34. Any combination of valves 36 may be opened or closed to change the volume of air within sealed air chamber 46. Preferably, valves 36 are electrically or hydraulically opened and closed although other alternatives will be readily apparent to one skilled in the art. Changing the volume of air within air chamber 46 changes the stiffness of the air spring.

Preferably, the volume of air within the air chamber is selected to achieve a spring rate that will align the natural or resonance frequency of the device with the desired operating frequency. Providing a means to vary the volume of air in the chamber 46 increases the range of operating frequencies. The highest operation frequencies, preferably between about 120 Hz and 250 Hz, are achieved when all compartments are closed. The lowest operation frequencies are achieved, preferably about 10 Hz, are achieved when all compartments are open.

By providing for the operation of the device at mechanical resonance, the overall performance of the device is improved. When operating at mechanical resonance, the magnetic force required to maintain the desired motion of the pistons is minimized. Thus, the current required to create the magnetic force is also reduced and a smaller amplifier may be used to power the device.

Operating the device at mechanical resonance also simplifies the control of the device. The control is simplified because the moving mechanical parts, i.e. pistons and springs, will filter out unwanted motion at harmonic frequencies. Thus, the control device will not need to account for the unwanted motion.

Figure 7:
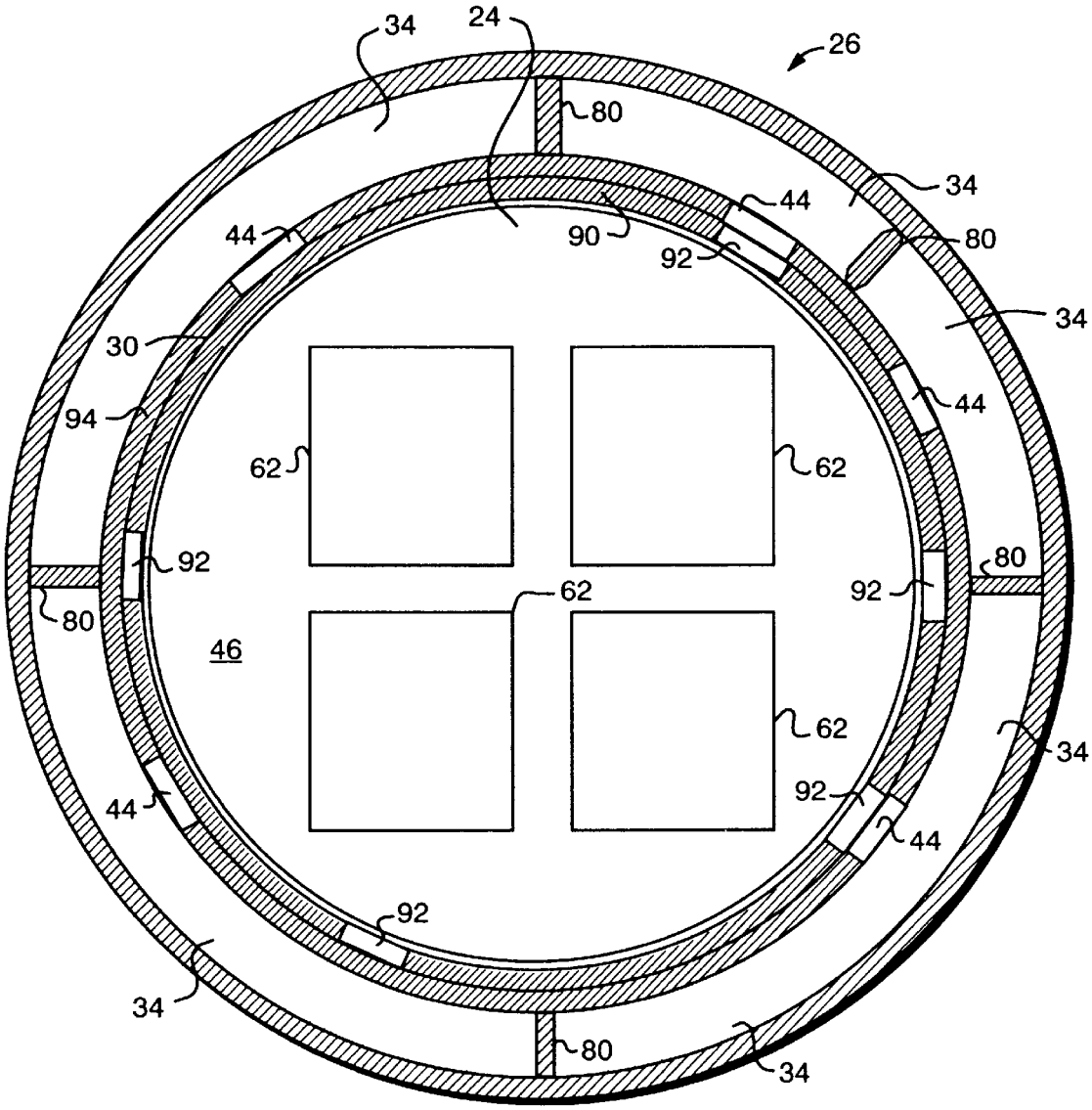
FIG. 7 is a top cross sectional view of another embodiment of the air spring of the present invention.

In another embodiment of the present invention, as illustrated in FIG. 7, a rotatable ring 90 is positioned between sealed air chamber 46 and outer casing 26.

Outer casing 26 includes compartments 34 bordered by an interior wall 94 having a port 44 for each compartment. Rotatable ring 90 has a series of openings 92. Openings 92 are positioned to align with ports 44 of compartments 34.

Figure 8:
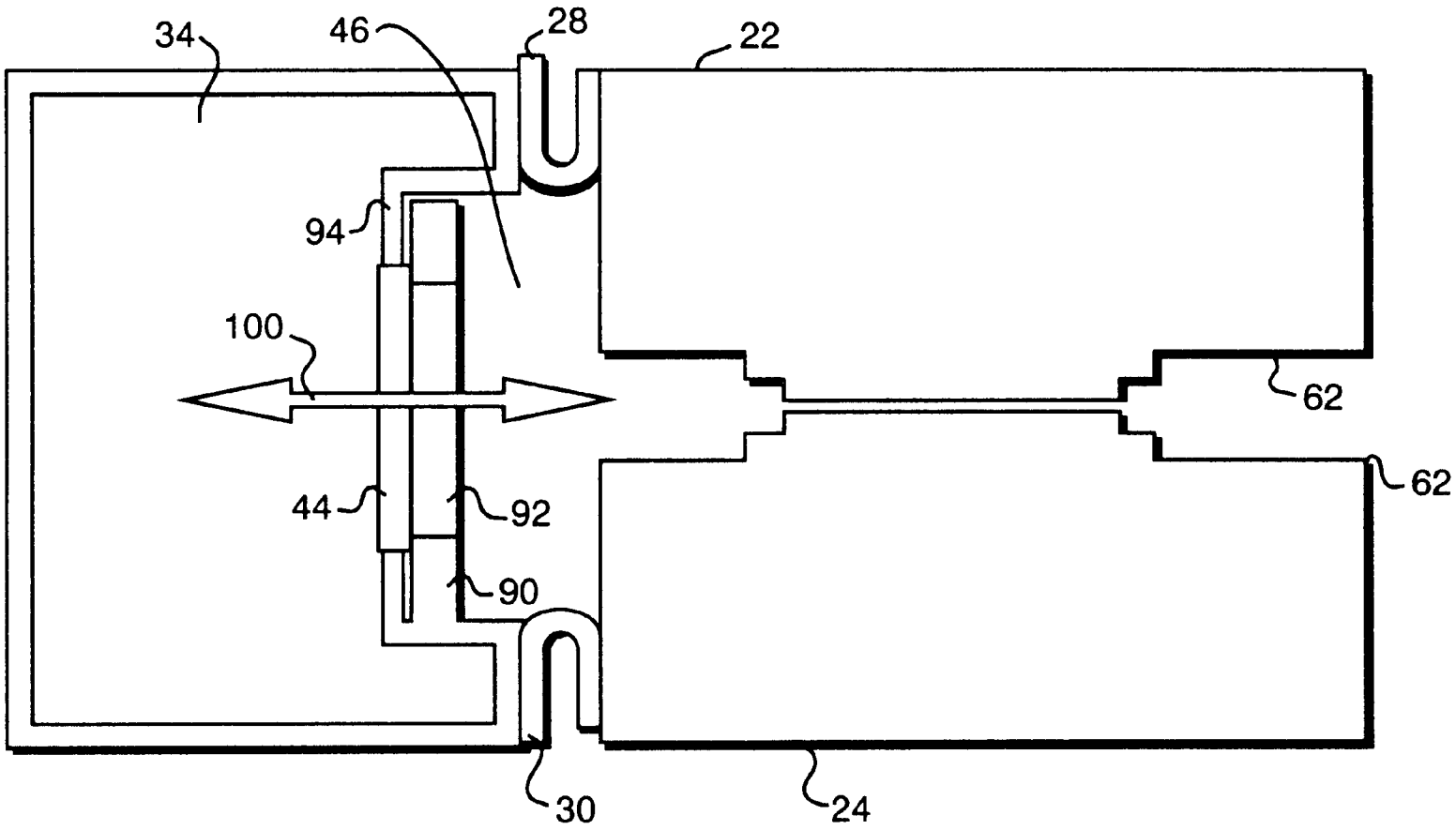
FIG. 8 is a partial side cross sectional view of air spring of FIG. 7.

As illustrated in FIG. 8, rotatable ring 90 may be rotated to align openings 92 with ports 44 of various compartments 34 to thereby alter the volume of air exposed to the sealed air chamber 46. When first piston 22 moves towards and away from second piston 24, air may flow between air chamber 46 and compartment 34 as indicated by arrow 100.

In accordance with the present invention, a control device can also be provided. The control device is electrically connected with the electromagnets. The control device regulates the flow of electricity to the electromagnet to induce a predetermined variance of axial displacement between the first and second pistons. A displacement device may also be included in the present invention. The displacement device monitors the relative displacement between the first and second piston and provides feedback to the control device to ensure that the movement of the pistons conforms to the predetermined variance.

Figure 9:
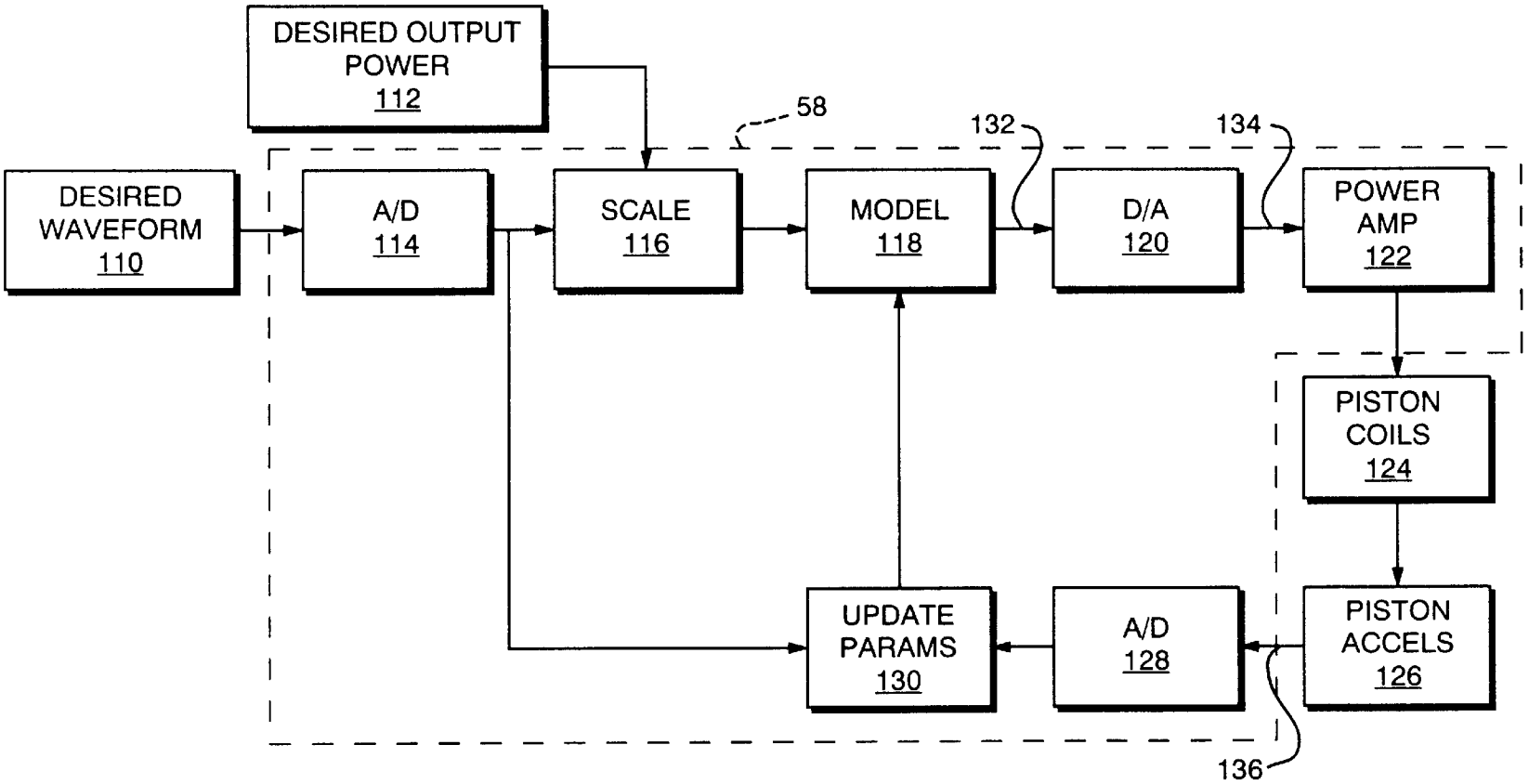
FIG. 9 is a schematic view of the control device of the present invention.

As embodied herein and illustrated in FIG. 3, a control device 58 is connected to wire 54. Control device 58 includes a user interface. As shown in FIG. 9, the user inputs a desired waveform 110 and the desired output power 112 of the waveform. The control device also includes a projector model 118 to determine the required motion of the pistons to achieve the desired waveform 110 at the desired output power 112.

Control device 58 includes a power amplifier 122 to provide the electrical power to achieve the desired output power. The present invention contemplates producing a sound wave having a power output of at least 100 W.

Control device 58 controls the motion of the pistons by changing the current traveling through the circuit as a function of time. Changing the current in the circuit changes the force generated by the electromagnets. In this manner, the relative motion of the pistons may be controlled to induce a predetermined variance of axial displacement between the first and second pistons. The present invention also contemplates controlling the motion of the pistons by changing the voltage applied to the circuit as a function of time. Because the current in the circuit is dependent on the applied voltage, changing the voltage will change the force generated by the electromagnets.

As illustrated in FIG. 2, a displacement monitoring device 42 may be mounted on first and second pistons 22 and 24. Displacement monitoring device 42 measures the actual relative displacement between first and second pistons 22 and 24 and provides feedback to the control device. The present invention contemplates the use of any displacement monitoring device readily apparent to one skilled in the art. In a preferred embodiment an accelerometer is mounted on each piston, although other devices, a linear variable displacement transformer (LVDT) for example, are capable of performing the same function. When accelerometers are used, they must be augmented by a means to measure the average gap distance. One method for this is to sense the average current in wire 54, for this quantity is indicative of the average gap distance.

The operation of the aforementioned device will now be described with reference to the attached drawings. As illustrated in FIG. 9, the desired waveform 110 and the desired output power 112 are input into control device 58. In the exemplary embodiment, desired waveform 110 is entered into control device 58 as an analog signal. Control device 58 includes a digital/analog converter 114 to convert the analog signal to a digital signal.

The digital signal of desired waveform 110 is then scaled 116 to the piston acceleration that will produce the desired output power 112. The scaled waveform piston acceleration can then be integrated once to obtain the desired piston velocity as a function of time and again to obtain the desired piston displacement as a function of time. A projector model 118 uses the acceleration, velocity, and displacement waveforms to determine the projector waveform 132.

The projector model includes a series of mathematical equations which may be solved to find the current as a function of time to be applied across the electromagnets to induce the desired waveform. The following equation gives the required gap force (F) in terms of the relative displacement, velocity, and acceleration of the pistons:

$$F = -k\cdot(x - x_o) - \frac{dx}{dt}\cdot(R_r + R_m) - \frac{d^2x}{dt^2}\cdot(M_r + M_m)$$

where:

k is the spring constant of the main spring x is the gap distance from the central plane to the magnetic core face;

$x_o$ is the initial gap distance from the central plane to the magnetic core face;

$R_r$ is a radiation parameter given by:

$$R_r = \frac{\rho\cdot A\cdot\omega^2\cdot a^2}{2\cdot c}$$

$R_m$ is the mechanical loss parameter given by:

$$R_M = \frac{\omega\cdot M_m}{Q_m}$$

$M_r$ is the radiation parameter based on the piston shape, given by:

$$M_r = \frac{8}{3\cdot\pi}\cdot\rho\cdot A\cdot a$$

where $M_m$ is the piston mass;

a is the piston radius;

A is the face area of the piston; and $Q_m$ is the mechanical quality factor of the pistons.

The gap force may also be expressed as a function of the electromagnet parameters within the sound generating device:

$$F = \frac{M\cdot\Phi^2}{2\cdot\mu\cdot S}$$

Where, ϕ is the magnetic flux and is given by:

$$\Phi = \frac{N\cdot I\cdot\mu\cdot S}{2\cdot M\cdot x}$$

S is the cross sectional area of the series magnetic circuit;

N is the number of turns of wire around the magnetic pole;

I is the drive current flowing in wire 54;

M is the number of gaps between magnetic cores; and x is the distance between the central plane measured to the magnetic core face.

The voltage, V, induced in the coils in response to the drive current is given by:

$$V = N\cdot\frac{d\Phi}{dt} + I\cdot R_e$$

where $R_e$ is an electrical loss parameter given by:

$$R_e = 3\cdot N\sqrt{\frac{S\cdot\pi}{M}}\cdot 10^{-3}$$

Thus, the foregoing equations can be solved to determine the necessary current as a function of time to create the projector waveform 132. The projector waveform 132 is converted from digital to analog by converter 120. The converted projector waveform 134 is then amplified by a power amplifier 122 which applies the desired current through the piston coils 124 to create the desired gap variance.

When the current is passed through the wire 54 (referring to FIG. 3), the electromagnets 38 and 40 are energized and cause pistons 22 and 24 to move towards each other. The current in the electromagnets is changed with time to achieve the desired waveform. When the current is decreased the compressed air in sealed air chamber 46 moves pistons 22 and 24 away from each other. The axial displacement of the pistons results in the generation of a sound wave in the surrounding water body.

The actual acceleration of pistons 22 and 24 is measured 126 by the accelerometers 42 mounted on each piston. The acceleration of first piston 22 is summed with the acceleration of second piston 24 to determine the actual gap waveform 136. The actual gap waveform is 136 is fed back to control device 58 through converter 128. The desired waveform 110 is compared to the actual gap waveform 136. If the actual gap waveform does not conform to the desired waveform, control device 58 uses a gradient search algorithm to modify the projector model parameters 130 to conform the actual gap waveform to the desired waveform. This feedback loop takes place in real time and is an iterative process that can be repeated until the actual gap waveform matches the desired waveform.

It will be apparent to those skilled in the art that various modifications and variations can be made in the construction of this sound generation device without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed:

1. A device for generating a sound wave in a body of water, the device comprising:

first and second axially aligned pistons, at least one of the first and second pistons having an electromagnet mounted thereon for axial displacement of that one piston toward the other piston in response to activation of the electromagnet by an electric current to generate the sound wave in the body of water;

a main spring positioned between the first and second pistons, the main spring operating to bias the one piston away from the other piston; and a control device in electrical connection with the electromagnet, the control device operable to regulate the flow of electricity to the electromagnet to induce a predetermined variance of said axial displacement between the first and second pistons and thereby generate the sound wave.

2. The device of claim 1, wherein the predetermined variance of axial displacement between the first and second pistons generates a sound wave having a predetermined waveform.

3. The device of claim 2, wherein the component frequencies of the predetermined waveform is between about 10 Hz and 250 Hz.

4. The device of claim 1, wherein the electromagnet includes at least one magnetic core having first and second end portions and a wire coiled around each of the first and second end portions, the wire being connected to the control device, the control device operable to induce a current through the wire to activate the electromagnet.

5. The device of claim 1, wherein the pistons have a generally circular cross section.

6. The device of claim 5, further comprising a case surrounding the first and second pistons.

7. The device of claim 6, further comprising a first rolling seal positioned between the case and the first piston to prevent water from entering the device.

8. The device of claim 6, further comprising a second rolling seal positioned between the case and the second piston to prevent water from entering the device.

9. The device of claim 6, further comprising at least one centering spring positioned between the first and second pistons, the centering spring acting to align the first piston with the second piston, the centering spring having a spring rate lower than the spring rate of the main spring.

10. The device of claim 1, wherein the main spring is an air spring having a sealed air chamber, wherein the movement of the first piston towards the second piston compresses the air within the air chamber, the compressed air acting to repel the first and second pistons.

11. The device of claim 10, wherein the air spring includes a pressure regulator to control the pressure of the air within the air spring.

12. The device of claim 10, wherein the volume of the air spring can be controlled during operation to cause the device to operate at mechanical resonance at all frequencies within the operating range of frequency.

13. The device of claim 10, wherein the sealed air chamber includes a plurality of ports and a ring having a series of differently sized compartments is disposed around the sealed air chamber, the ports operable to expose different of said compartments to the sealed air chamber to vary the volume of the air.

14. The device of claim 13, wherein the ring is rotatably disposed around the sealed air chamber such that rotation of the ring causes different of said compartments to align with different of said ports to vary the volume of the air in the sealed air chamber.

15. The device of claim 14, wherein the ports include electronically controllable valves operable to expose different of said compartments to vary the volume of air in the sealed air chamber.

16. The device of claim 14, wherein the ports include hydraulically controllable valves operable to expose different of said compartments to vary the volume of air in the sealed air chamber.

17. The device of claim 1, wherein an electromagnet is mounted on the other of the first and second pistons for axial displacement toward the one piston in response to activation of the second electromagnet by an electric current.

18. The device of claim 17, wherein the electromagnet on each of the first and second pistons includes at least one magnetic core having a first and a second end and a wire is coiled around each of the first and second ends of each magnetic core, the wire being connected to the control device, the control device operable to induce a current through the wire to activate the electromagnet on each of the first and second pistons.

19. The device of claim 17, wherein the electromagnet on each of the first and second pistons includes two magnetic cores, the magnetic cores being aligned on each of the first and second pistons such that the magnetic flux flows through the magnetic cores in series.

20. The device of claim 1, wherein the power output of the generated sound wave is at least 100 W.

21. The device of claim 1, wherein the control device includes an amplifier.

22. The device of claim 1, further comprising a displacement device operable to monitor the relative displacement between the first and second pistons and to provide feedback to the control device to ensure that the axial displacement of the first and second pistons conforms with the predetermined variance.

23. The device of claim 22, wherein the displacement device includes a first accelerometer mounted on the first piston and a second accelerometer mounted on the second piston.

24. The device of claim 22, wherein the displacement device includes a axial variable displacement transformer to monitor the relative displacement between the first and second pistons.

25. A device for generating a sound wave in a body of water, the device comprising:

a first and a second piston, the first piston being disposed in axial alignment with the second piston;

an attracting means to attract the first piston toward the second piston;

a main spring positioned between the first and second pistons, the main spring operating to bias the first piston away from the second piston; and a controlling means for controlling the attracting means, the controlling means operable to regulate the attracting means to induce a predetermined pattern of movement between the first and second pistons and thereby generate the sound wave.

26. The device of claim 25, wherein the attracting means includes an electromagnet disposed on at least one of the first and second pistons.

27. The device of claim 25, further comprising a means of preventing water from entering the device.

28. The device of claim 25, further comprising a means for varying the stiffness of the main spring.

29. The device of claim 25, wherein the frequency of the generated sound wave is between about 10 Hz and 250 Hz.

30. The device of claim 25, wherein the power output of the generated sound waves at least 100 W.

31. The device of claim 25, further comprising a monitoring means for monitoring the relative movement of the first and second pistons and providing feedback to the controlling means to ensure the movement of the first and second pistons conforms to the predetermined pattern.

* * * * *